United States Patent [19]

Sanchez

[11] Patent Number: 4,681,238

[45] Date of Patent: Jul. 21, 1987

[54] RE-CLOSURE DEVICE FOR POP TOP CONTAINERS

[76] Inventor: Ruben G. Sanchez, 9234 S. Heather Dr., Tempe, Ariz. 85284

[21] Appl. No.: 914,829

[22] Filed: Oct. 3, 1986

[51] Int. Cl.[4] ..... B65D 17/50; B65D 41/02

[52] U.S. Cl. ..... 220/260; 220/270; 220/336; 220/263

[58] Field of Search ..... 220/260, 263, 270, 336, 220/269

[56] References Cited

U.S. PATENT DOCUMENTS

| | | | |
|---|---|---|---|
| 4,136,797 | 1/1979 | Potts | 220/336 |
| 4,410,101 | 10/1983 | Vogt | 220/260 |
| 4,442,950 | 4/1984 | Wilson | 220/336 |
| 4,463,866 | 8/1984 | Mandel | 220/269 |

*Primary Examiner*—George T. Hall

*Attorney, Agent, or Firm*—Charles P. Padgett, Jr.

[57] ABSTRACT

A resealable, anti-litter-type pop top beverage container wherein a rotatable tab member can be raised to depress a sealing member into the interior of the container to fully expose the lid opening for drinking or the like. The sealing member includes a second resealing lobe integral therewith and responsive to the rotation of the tab in a first direction for positioning the resealing tab beneath the lid opening and resealing the opening in an air-tight manner to prevent the escape of gases therefrom thereby preventing the beverage stored therein from going flat. The second or resealing member is also responsive to the rotation of the tab member in the opposite direction for unseating the resealing member and reexposing the lid opening to enable the remaining stored liquid contained therein to be drunk or poured therefrom.

14 Claims, 12 Drawing Figures

RE-CLOSURE DEVICE FOR POP TOP CONTAINERS

BACKGROUND OF THE INVENTION

1. Field of the Invention

This invention relates generally to a resealable closure device for a container, and more particularly to a recloseable device for aluminum beverage cans having a pop top apparatus.

2. Description of the Prior Art

Beverage containers commonly are opened using anti-litter tabs known as pop tops. The general feature of a conventional pop top may be found in U.S. Pat. No. 4,463,866 which issued to George Mandel on Aug. 7, 1984 for a "Contamination Protection Member For Opening and Resealing Device". An upward or lifting force is applied to a pop top and it shears away a substantial portion of the container lid or top from the container so as to create an aperture or opening for the egress of liquid from the container. A section of the pop top does not shear such that the pop top remains attached to the container even though it is pressed down into the interior thereof. This prevents the litter and pollution which would otherwise occur such as with prior art pull tabs which were discarded once they were removed from the top of the containers.

The pop top cannot normally be used to reseal the container although a few resealing concepts have been proposed in the prior art. For example, in U.S. Pat. No. 4,232,797 which issued Nov. 11, 1980 to Nelson J. Waterbury for a "Recloseable Container". In this patent, a container having an articulated closure for an opening in the lid in which one end of the closure is mounted on the lid adjacent the inner end of the opening and a closure element is hinged to the mounted end and overlays the opening to seal the contents. A lift element is integrally formed on the closure element opposite the mounted end to lift the closure element pivotly relative to the mounted end to provide access to the opening for the discharge of the contents of the container. This invention requires a totally different type of pop top wherein the sealing portion is picked up out of the can interior rather than pushed down into the can.

As recognized by those skilled in the art, an unsealed or unsealable container must be emptied and discarded because dissolved gases within the beverage escape and the beverage is said to "go flat". U.S. Pat. No. 4,434,906 issued on Mar. 6, 1944 to Rolf Florczyk for a "Container Having Resealable Opening Means". This patent teaches, in a sheet metal or plastic container for storing beverages and the like, a plug member located against the opening region provided in the container's end wall for defining a score line. The plug member has a closing peripheral edge which has the same geometry as the peripheral edge of the opening resulting after the score line is ruptured by external pressure applied to the plug member towards the interior of the container. The plug member, after the opening region has been ruptured, is slidably displaced from the opening to expose the later. That opening can be tightly closed again by the plug member being inserted by its peripheral edge into the opening.

U.S. Pat. No. 3,952,914 issued on Apr. 27, 1906 to Kuno J. Vogt for a "Re-sealable Container Lid". This patent teaches a reuseable container lid for utilization, for example, carbonated beverage containers having a metallic lid or pouring aperture therein and having a removeable seal within the aperture which is constructed of displaceable material such as rubber or plastic. The seal includes a base pad with a raised portion at one end forming a sealing pad and a pull tab extension on the sealing pad. The base pad is dimension for fitting beneath the aperture in the lid and covering the aperture with the sealing pad dimension for extending into and sealing the aperture. The pull tab extension extends the top of the sealing pad for opening and re-sealing operations. Again, the tab apparatus requires a totally different configuration and it cannot be used with the conventional tab apparatus commercial in use today.

U.S. Pat. No. 3,259,265 issued on July 5, 1966 to E. P. Stuart for a "Reseal For Tab Opening Cans". In the patent to Stuart, the invention provides a reseal which will remain in place at the portion thereof which seals the inner end of the channel or the rivet aperture at the inner end of the channel, but it has a snap fit into the channel and pour aperture at the outer end of the channel. Again, a completely different type of pull tab is required.

U.S. Pat. No. 4,083,471 issued on Apr. 11, 1978 to Howard A. Frank for a "Re-sealable Frangable Top for Containers". The patent shows a frangible top can which has a top containing a laminated two-layer insert which comprises an upper plate containing a scored area and a lower plate having an opening. A depression, formed in the upper plate, fits snugly into the opening which is formed in the lower plate. Thus, the depression may act as a stopper for the opening when the can is resealed. This also requires a totally different abstructure from that conventionally used today.

U.S. Pat. No. 4,267,938 issued to Michael Debenham et al on May 19, 1981 for a "Resealable Pressure Release Closure". This patent shows a pressure-releasing closure or tab which has a connection to the can end which is substantially at the same level as the adjacent portion of the closure by the provision of an area immediately behind the connection which is downwardly depressed so as to be coplanar with the tab. Again the pressure release closure of the present invention is totally different and cannot be used in combination with the popular pop tops in commercial use today.

U.S. Pat. No. 3,952,911 issued on Apr. 27, 1976 to John S. Bozek et al for a "Non-Detachable and Recloseable Easy Opening Container Closure Structure". This patent shows an easy-opening closure for a container in which the end panel is formed with a pre-cut opening. A plastic tab having a closure portion is pivotally secured to the panel for turning between a position overlying said opening to seal the same and a position away from the opening. The tab includes a finger grip portion encompassing the closure portion. Again, this patent cannot be used with the pull tab structure in commercial use today.

U.S. Pat. No. 4,215,791 issued on Aug. 5, 1980 to Wilfred R. Brochman for an "Easy Open Closure System". This patent teaches an improved, easy-open closure system which comprises an interior sheet material and an exterior flexible film. The exterior flexible film is essentially free of adhesive and is secured to the inner interior sheet of material in the area of the opening by means of an adhesive layer on the interior sheet of material. Again, the tab structure is totally foreign to that in common use today and cannot be used in combination therewith.

Lastly, U.S. Pat. No. 3,327,891 issued on June 27, 1967 to G. F. Smyth for a "Can End With Inseparable Tear Strip". This patent teaches an early version of the anti-litter pull tab concept of the prior art but does not provide any type of resealing means.

The prior art, in general, does show various types of systems for resealing the cans after they have been initially opened. All of these systems suffer from one or more problems as evidenced by the fact that none of these systems have gained any commercial acceptance today, whatsoever. Rather, the basic pulltop mechanism in use today has gained a universal acceptance over all of these systems and no resealing means is used. None of the prior art reseling systems can be used in conjunction therewith.

The present invention solves substantially all of these problems while avoiding their shortcomings and provides a recloseable device for aluminum pop top cans wherein the device can be used, with little modification in combination with the conventional pop top can apparatus in commercial use today.

OBJECTS OF THE INVENTION

It is an object of the present invention to provide a resealable closure device for conventional pop top containers.

It is another object of the present invention to provide a resealable closure device which can be used in combination with the pop top construction in commercial use today.

It is still another object of the present invention to provide a new pop top closure assembly which includes resealable means but which will maintain the accepted external appearance of the beverage containers.

It is yet another object of the present invention that it will work not only on metal containers such as aluminum cans but also on the newer plastic beverage containers currently being test marketed.

It is a further object of the present invention to provide a recloseable apparatus for conventional pop top configurations which will require a minimum of alteration and a minimum of additional weight to the containers.

It is still a further object of the present invention to provide a resealing member for pop top containers which will provide an air-tight seal to prevent the carbonated gas from escaping from the beverage within the container.

It is yet a further object of the present invention to provide a sealing element for use with conventional pop top containers where the opened containers may be resealed by rotating the seal tab member move a liner against the underside of the container top to create a reseal as the tab and liner is moved against the underside of the container top directly beneath the opened aperture.

BRIEF SUMMARY OF THE INVENTION

The present invention provides a resealable pop top for beverage containers including a flat pair of lobes which are an integral part of the pop top and which are rotatable with respect to the container. The lobes are positioned under the lid so that rotation of the pop top brings the sealing flap into just the position with the aperture formed when the can is opened whereupon a seal of the aperture is accomplished by the resealing lobe or flap, against the opening from beneath the lid of the can. The reseal can be forced by the spring tension produced in the metal of the lobe itself and aided by the internal gas pressure or by a positive seal arrangement whereby rotation of the flap or lobe wedges it into a groove. Any of the above resealing forces are effective to produce an air-tight seal of the rotating lobe or sealing flap against a sealing seat beneath the opening.

These and other objects and advantages of the present invention will become more fully understood after reading the detailed description of the preferred embodiments, the claims, and the drawings which are briefly described hereinbelow.

DETAILED DESCRIPTION OF THE PREFERRED EMBODIMENT

Figure 1:
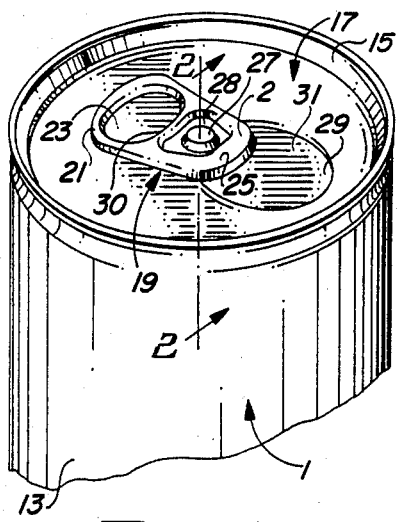
FIG. 1 is an isometric view, partially broken away, of a beverage container showing a conventional sealed pop top apparatus.

FIG. 1 shows a can or container 11 having a cylindrical can body portion 13, an upper rim portion 15, and a generally planer top surface or lid 17. Disposed on the lid 17 is a pop top apparatus 19 which includes an outer end portion 21 surrounding a finger aperture 23, an intermediate portion 30 and a forward end portion 25 surrounding a rivet aperture 28 which is recessed. A rivet assembly 27 is housed within the recess 28. A seal member 31 integral with a top surface 17 of the can 11 and disposed in the aperture 29 through which the liquid is drunk or poured once the tab 19 is lifted to depress the forward end 25 down on the score tab portion 31 to pop or open tab 31 along its score lines and press it down into the can so that the beverage disposed therein can egress through the opening 29 left by the depressed portion 31.

Figure 2:
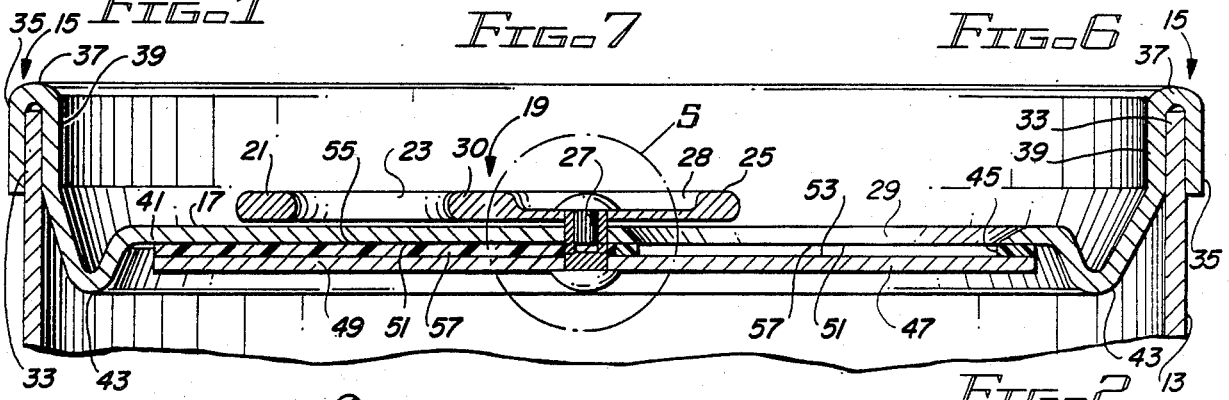
FIG. 2 is a sectional side view, exploded in size, taken along view lines 2—2 of FIG. 1.

FIG. 2 shows a rim 15 as including an outer, downwardly turned rim lip portion 35, a rounded portion 37 or lip top disposed over the upper end of the can body portion 33 while an inside downwardly turned lip portion 39 generally parallel to the lip portion 35 extends down over the opposite side of the upper end portion 33 of the can body 13. An intermediate, U-shaped depression portion 43 connects the downwardly turned inner lip 39 to the lid 41 having the upper surface 17 thereon. Rivet recess, indention or impression 28 is shown as being formed as an indentation between the intermediate member 30 and the forward edge 25. The rivet assembly 27 will be further described with reference to FIG. 5.

It will also be seen that a lower or inside surface 51 of the container top 41 disposed on the inside of the container faces on a sealed surface 57 which is disposed on the top surface 53 of the original or first sealing lobe or flap member 47. The outer peripheral edge of the first original sealing lobe 47 is tightly disposed against the lower inner surface 51 of the lid 41 of the container 11 by a resilient seal 45 and the sealing layer 57 as previously described. Similarly, a second resealing lobe or flap member 49 is integral with and disposed at an angle to the first flap member 47 and includes a sealing layer 57 disposed on the top surface 55 of the resealing lobe 49.

Figure 7:
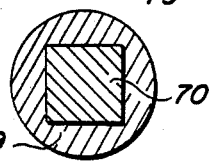
FIG. 7 illustrates an alternate embodiment to the drive member of FIG. 6.
Figure 3:
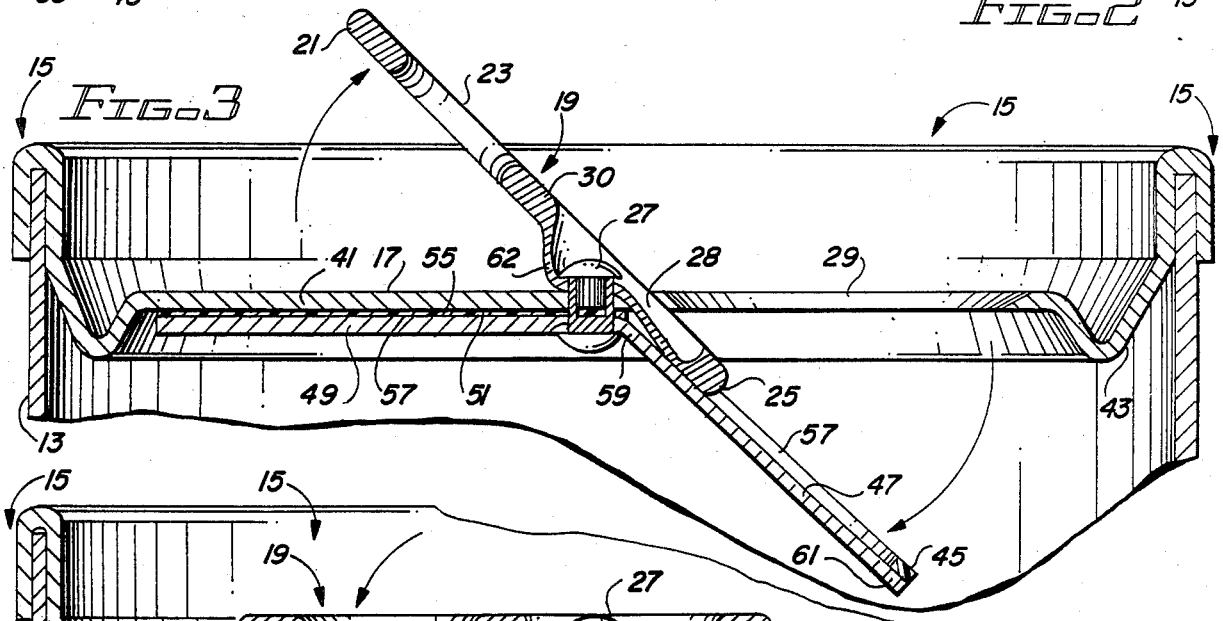
FIG. 3 represents the pop top configuration of FIG. 2 where the pop top is flipped upward to open the container.

FIG. 3 illustrates the pop top assembly 19 as including a rear portion 21 and finger aperture 23 of the pop top assembly 19 is grasped and lifted from a position parallel to the top surface 17 of the lid 41 as shown in FIG. 7 to the position making an acute angle to the plane of the top surface 17 is shown in FIG. 3. In this position, the under surface and distal end of the forward portion 45 is levered downward across a fulcrum formed by the portion 62 such that the forward end 25 separates the undersurface layer 51 of the lid 41 and the resilient seal 45.

When manual pressure is applied to the finger aperture 23 and end portion 21 of pop top tab assembly 19, the forward distal lip 25 transmits the force downwardly toward the interior 14 of the container 13. This breaks the seal about the pour aperture 29 and bends the first sealing lobe 47 with its resilient sealing layer 57 down into the hollow interior 14 of the cantainer 13. The end portion 61 contains a resilient seal 45 on the upper surface thereof. The bend is formed on the right hand side of the rivet 27 as indicated by bend point 59. Meanwhile, on the opposite side of the rivet 27 is a bend or fulcrum point 62 about which the intermediate portion 30 of the tear tab 19 is raised and rotated.

It will be seen that the second or resealing lobe or tab 49 is physically connected to and integral with the first lobe 47 and extends on the opposite side of the rivet 27 generally with its longitudinal axis at an obtuse angle to the longitudinal axis of the first sealing lobe 47. The upper surface 17 of lid 41 is generally planar and the opposite surface 51 is disposed against the sealing layer 57 on the upepr surface 55 of the second or resealing lobe member 49.

Figure 4:
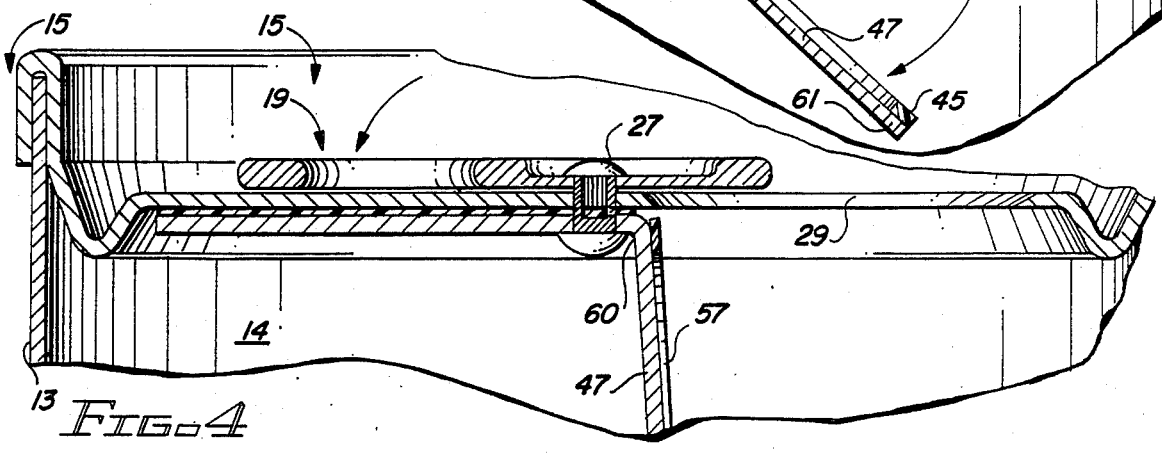
FIG. 4 illustrates the pop top configuration of FIG. 3 after the raised tab has been pressed back onto the surface of the container.

FIG. 4 shows a sectional view similar to that of FIG. 3 wherein the end portion including end member 21 and aperture 23 of the tab assembly 19 has been raised to a nearly vertical position and then bent back or returned rearwardly about the rivet 27 or point 62 to lie flush against and generally parallel to the top surface 17 of the lid 41 of the container 13. In this manner, the original sealing lobe 47 is bent downward into the hollow interior 14 of the container 13 to form nearly a right angle with respect to the plane of the second lobe 49. The bend is about the bend point 60 and forms an obtuse angle with respect to the plane of the second lobe 49. In this manner, the original seal tab 47 and its sealing layer 57 is not physically detached from the container 11 itself but remains attached to serve an anti-litter and environmental purpose as well as for preventing the tab 47 from falling into the can and being inadvertantly swallowed or ingested by the person drinking therefrom.

Figure 5:
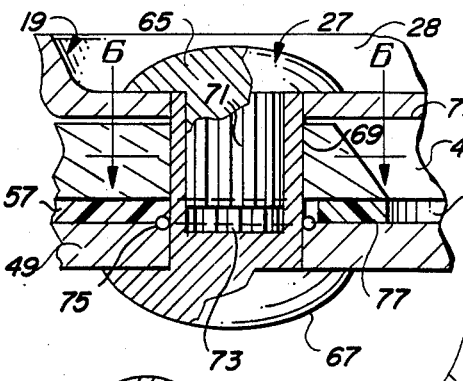
FIG. 5 is an exploded view of the encircled area of FIG. 2.

FIG. 5 shows a blown up view, partially in section, of the portion of FIG. 1 contained within the circle designated by reference number 5. In FIG. 5, the pop top tab assembly 19 is shown as having a recess or indentation 28 having a floor with an upper surface 79 thereon. The rivet head and peripheral over hang portion of the rivet head assembly 27 including the upper rivet head 65 is disposed on the upper surface 79 of the bottom of the recess 28. Similarly, the first lobe seal member 47 is shown as having its seal layer 57 and the resilient seal portion 77 about the periphery thereof connected by a weld 75 or the like to the exterior surface of the bottom rivet stem portion 69 including the head 67 which overlies the lower surface of the first lobe 47 and the lower surface of the second or resealable lobe 49. The weld actually connects the first sealing lobe 47 and the second resealing lobe 49 to the outer cylindrical exterior portion 69 of the rivet stem 67 having a hollow central interior therein. The spline shaft portion 71 of the rivet 65 is fitted within the hollow interior of the stem portion 69 of rivet 67 for interconnecting same. The top lid 41 is shown as being sandwiched between the recess portion 28 and the sealing tabs or lobes 47 and 49. Between the two lies the layer of resilient sealing material 57.

The connection is such that when the tab 19 is rotated about the axis of the rivet portions 27, the hollow stem portion 69 of the lower rivet 67 will turn with the upper tab end with the lower sealing tabs 47 and 49 welded to the exterior thereof.

Figure 6:
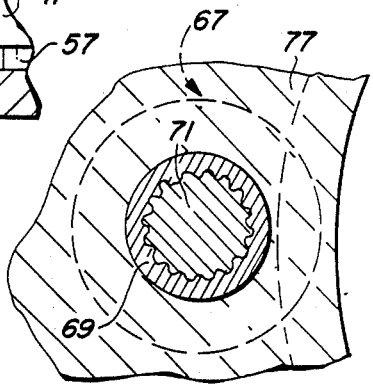
FIG. 6 is a top view taken along view lines 6—6 of FIG. 5.

FIG. 6 discloses a sectional top view of the rivet assembly 27 of FIG. 5 taken along view lines 6—6 thereof. FIG. 6 illustrates the outer edge of the plastic seal 77, a position of the lower rivet head 67, the outer peripheral sleeve portion 69 attached or integral with the rivet head 67 and the interior sprocket drive portion 71 of the top rivet 65.

FIG. 7 shows an alternate to the splined drive section of FIG. 6 wherein the outer peripheral sleeve portion 69 of the rivet 67 has a generally square interior channel fitted with a rectangular member 70 for turning the lower rivet 67 with the rotation of the tab assembly 19, as previously described.

Figure 8:
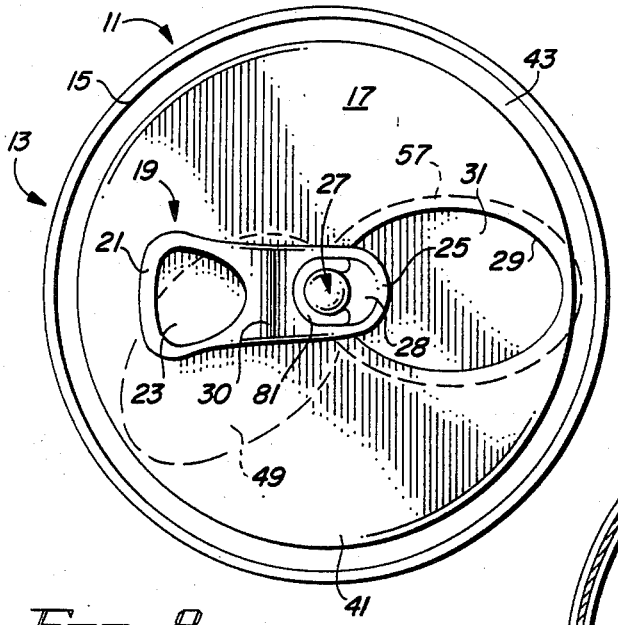
FIG. 8 is a top plan view of an unopened pop top can including the resealing member of the present invention.

FIG. 8 shows a container 11 having cylindrical can body portion 13, an upper rim 15, a depression interior of the rim represented by reference numeral 43, and a central lid 41 having a top lid surface 17. Approximately centered on the top surface 17 is a pop top tab assembly 19 including a lift tab portion having a rear portion 21, a hollow finger grip interior 23, an intermediate portion 30, a depression or recess 28, and a forward distal end portion 25. Disposed within the recess 28 is a rivet assembly 27 surrounded by a U-shaped rivet clip 81 as shown in FIG. 8.

FIG. 8 also shows a sealing lobe 31 which seals the aperture 29 of the lid 17. The upper layer of the lobe seal member 31 includes the seal layer 57. A second lobe portion 49 is shown as having a longitudinal axis at an obtuse angle to the longitudinal axis of the first lobe portion 31 and they are interconnected at the rivet assembly 27 as previously described.

Figure 9:
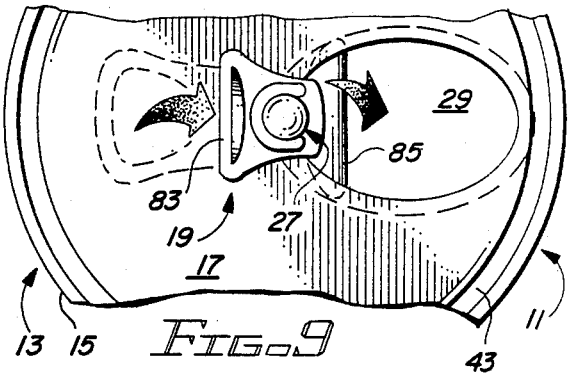
FIG. 9 is a top plan view of the can of FIG. 8 with the pull tab raised to open the container.

FIG. 9 shows the container 11 of FIG. 8 with the tab member 83 bent upward from its depressed position in which its plane is generally parallel to the lid 17 to an point where it makes an acute angle at the plane of the lid 17. The upwardly turned or bent portion 83 of the tab assembly 19 is generally bent about the rivet assembly 27 so that the seal tab is broken about the pour aperture 29 and the sealing lobe 31 is bent down into the interior of the can as indicated by the downwardly turned bent seal portion 85.

Figure 10:
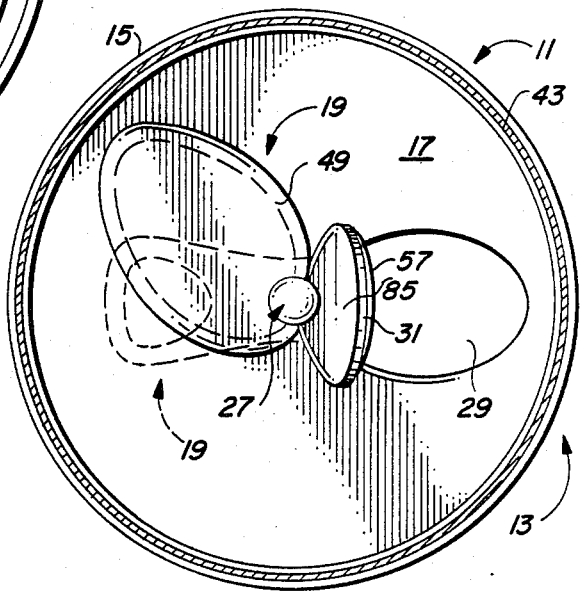
FIG. 10 is a sectional bottom view through the can of the position of the original sealing member and resealing member of the present invention.

FIG. 10 shows the top of the can when viewed from within the interior thereof. In FIG. 10, it will be seen that the tab member 19 has been bent back or restored to its position generally parallel to the top lid 17 and the sealing tab lobe 31 is depressed completely within the interior of the can at almost a 90° angle to the plane of the lid. The pour opening or drink aperture 29 is opened or unsealed so that the liquid within the container can be poured or drunk therefrom. The bent in portion 85 of the sealing tab 31 is shown as being pivoted generally about the rivet assembly 27.

Figure 11:
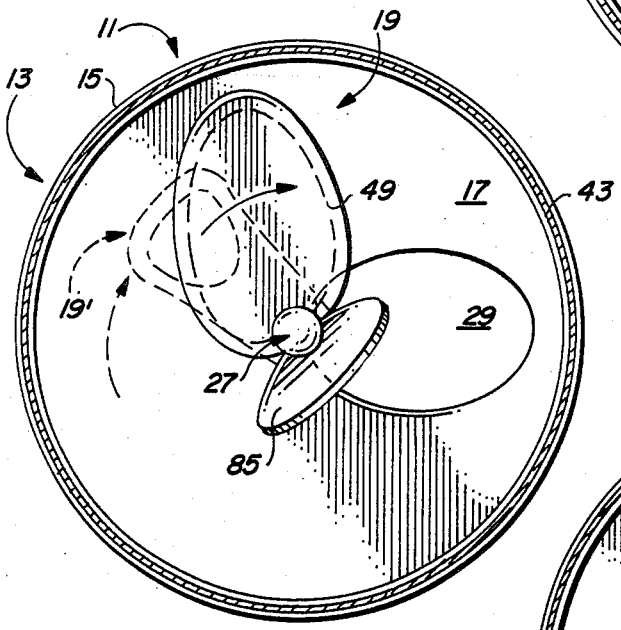
FIG. 11 is a view similar to that of FIG. 10 as the tab is rotated with respect to the can.

FIG. 11 shows the top of FIG. 10 with the tab assembly 19 being rotated in a clockwise direction so as to turn the resealing lobe 49 which is disposed approximate to the lower or interior surface of the lid 17 while the downwardly bent portion 85 of the original sealing lobe 31 turns with the rotation of the tab assembly 19' about the pivot pin means or rivet means 27.

Figure 12:
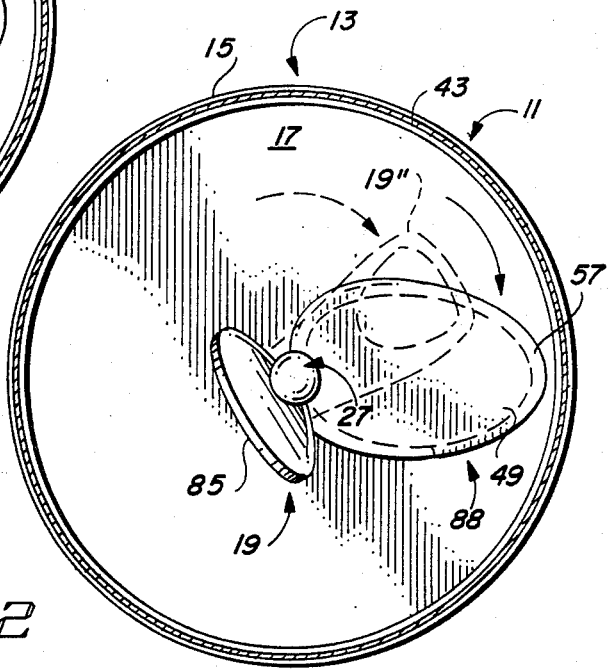
FIG. 12 is a view as shown in FIGS. 10 and 11 with the tab turned until the resealing lobe positioned under the opening to reseal container.

Lastly, FIG. 12 illustrates the top assembly of FIG. 11 wherein the tab assembly 19'' has been rotated until the resealng tab or lobe 49 is positioned immediately beneath the aperture 29 so that the sealing layer 57 seals against the bottom interior surface of the lid 17 and prevents the escape of gas from within the container thereby preventing the beverage stored therein from going flat. Reference numeral 88 indicates a reseal or new seal about the periphery of the aperture 29 comprising the rotated lobe 49 and its upper sealing layer 57. In this position, both the tab 19'' and the inwardly bent portion 85 of the original sealing tab 31 are out of the way since the original sealing tab 31 is bent into the interior of the container 11 and it totally out of the way of the new seal while the tab assembly 19—is generally flush to the top of the can or raised slightly therefrom so that it can be regrasped and rotated in the opposite direction when it is desired to reopen the seal from the aperture 29 to drink or pour the stored liquid therefrom.

It will be obvious to those of ordinary skill in the art that various modifications, changes, variations, alterations, substitutions and the like can be made in the present invention without departing from the spirit and scope thereof which is limited only by the apended claims.

What is claimed is:

1. A resealable beverage container having an interior for containing beverages, a top lid, a lid opening for egressing liquid from within the interior of the container, and a conventional pop top means including a tab lever member, said resealable beverage container comprising:

an original sealing member operatively disposed within the interior of said container flush beneath said lid opening for forming an air-tight seal between the interior of said container and said lid opening;

a resealing member operatively disposed within the interior of said container and integral with said original sealing member and connected thereto for rotation therewith;

rivet means for operatively coupling a conventional pop top tab member lever onto the lid of the container, said rivet means being operatively coupled to the junction of said first and second integrally connected original sealing and resealing members and to an intermediate portion of said tab member;

one end of said tab member being responsive to a lifting force applied to the opposite end portion thereof for pivoting said tab member lever about said rivet means and forcing said original sealing member out of sealing engagement with said lid opening and bending same down into the interior of said container; and at least said resealing member being responsive to the rotation of said tab member lever in a first direction after said lid opening is unsealed for sliding said sealing member along the inner surface of the lid of said container and repositioning same immediately beneath said lid opening for sealing said lid opening in a liquid-tight manner to prevent the escape of carbonated gases therefrom thereby preventing the remaining beverage within the interior of said container from going flat, said resealing member being responsive to the rotation of said tab member lever in the opposite direction for opening and unseating said sealing member and uncovering said lid opening to permit the beverage remaining therein to be poured therefrom.

2. The resealable beverage container of claim 1 wherein said first original sealing member includes a first generally oval-shaped piece of relatively flat material equivalent to the material from which said container is manufactured; and said second sealable member includes a second oval-shaped piece of relatively flat material equivalent to the material from which the container is manufactured.

3. The resealable beverage container of claim 2 further including a neck portion of said material equivalent to the material from which said can is manufactured integrally interconnected to the oval-shaped portion of said original sealing member with the oval-shaped portion of said resealing member for forming an integral unitary piece.

4. The resealable beverage container of claim 3 wherein said tab member includes a first grasping portion adapted to be grasped by a human digit and lifted to rotate the tab member about the rivet and force the distal end portion thereof downward toward the interior of the container for breaking the original seal and opening the container.

5. The resealable beverage container of claim 4 wherein an intermediate portion of said tab member includes a recess and wherein said rivet means is operatively housed at least partially within said recess for securing said tab member to said rivet means.

6. The resealable beverage container of claim 5 wherein said rivet housed within said recess includes a head portion and a downwardly distending splined stem portion; said rivet means further including a second rivet head operably disposed within the interior of said container through the the neck member between the oval-shaped portions of said original sealing member and said resealing member, said lower rivet head having an upwardly disposed hollow cylindrical sleeve, the hollow interior of said sleeve being adapted to receive the splined stem of said top rivet therein.

7. The resealable beverage container of claim 6 wherein said recessed portion of said tab member is retainably clamped within the hollow cylindrical stem of the bottom rivet by the head of said top rivet, and the portion of the oval-shaped original sealing member and resealing member is fixedly secured to the exterior surface of the cylindrical stem of the lower rivet such that the lower rivet turns with the upper rivet so that the integrally connected oval-shaped original sealing member and resealing member rotate with the rotation of said tab member about said rivet.

8. The resealable beverage container of claim 1 further including a resilient strip of sealing material at the peripheral edge of said original sealing member.

9. The resealable beverage container of claim 8 wherein the upper surface of each of said oval-shaped sealing members each include a coating of plastic sealing material.

10. The resealable beverage container of claim 9 wherein the material of said beverage container and said tab assembly includes metal.

11. The resealable beverage container of claim 10 wherein said metal is aluminum.

12. The resealable beverage container of claim 1 wherein the material of said container and said tab assembly includes plastic material.

13. An improved pop top beverage container having an interior for housing a carbonated beverage which will go flat if left opened for a predetermined period of time, said container including a top lid having a lid opening and a pop top assembly including a tab member lever including a first end portion adapted to be grasped by one or more of a persons fingers for applying a lifting force thereto for opening the container, and an opposite end portion including a lip for bearing down on the surface of the original seal for unseating said seal and exposing the lid opening, and an intermediate portion including a portion containing a rivet means, the improvement comprising:

said rivet means including a top rivet head having a downwardly disposed stem portion, a bottom rivet head having a upwardly disposed hollow cylindrical stem including a hollow central interior adapted to retainably receive the downwardly distending stem portion of said top rivet therein, said rivet assembly interconnecting said tab member lever with said seal, an integrally-formed, double-lobed sealing means wherein each of said lobes is a generally oval-shaped member dimensioned to overlay and cover said lid opening for sealing same, said oval-shaped lobes being interconnected by an integral neck portion, said neck portion being operatively coupled to said rivet means for rotation therewith;

one of said oval-shaped lobes being originally disposed under said lid opening for covering same in a seal-forming airtight manner, said original sealing lobes being unseated by the downward application of force applied from said opposite end portion of said lip at the opposite end portion of said tab member lever as first end portion is lifted for bending said neck portion before said first oval-shaped lobe into the interior of the container for fully exposing said lip opening; and the opposite one of said lobes being responsive to the rotation of said tab member lever about said rivet means for repositioning said second lobe under said lip opening and overlying said same for resealing said lip opening to prevent the escape of carbonized gases from the interior of said container so as to prevent the beverage contained therein from going flat, said opposite one of said lobes being responsive to the rotation of said tab member lever in the opposite direction for unseating said seal and reexposing said lid opening for enabling the remaining beverage to be removed from the container.

14. An improved beverage container having an interior for containing liquid, a lid for sealing the container, and a lid opening, said improvement comprising:

a pop top tab assembly including a tab member having one end portion adapted to be lifted by the application of force thereto, a pivot means operatively connecting the intermediate portion of said tab member to the lid and the opposite end portion including a lip, said lip being pushed downward in response to the lifting at the opposite end of said tab member;

a first sealing member dimensioned to overlay said lid opening and being adapted to be operatively disposed beneath said opening within the interior of said container for sealing said lid opening;

a second sealing member integral with a portion of said first sealing member for resealing said lid opening once said first sealing member has been unseated;

said first sealing member being responsive to the application of downward force applied thereto by the opposite end of said tab member for unseating said first seal member and bending same into the interior of said container for fully exposing the lid opening; and means responsive to the rotation of said tab member in a first direction about said pivot means for repositioning said second seal under the said opening for resealing same in an airtight manner to prevent the escape of gas from the interior of said container and responsive to the rotation of said tab member in the opposite direction for reopening said lid opening and reexposing said opening to enable the remaining beverage store therein to be removed.

* * * * *